US009962945B2

(12) United States Patent
Takaoka et al.

(10) Patent No.: US 9,962,945 B2
(45) Date of Patent: May 8, 2018

(54) LIQUID EJECTING DEVICE, HEAD, AND LIQUID FILLING METHOD

(71) Applicant: CANON KABUSHIKI KAISHA, Tokyo (JP)

(72) Inventors: Tsubasa Takaoka, Tokyo (JP); Keisuke Iinuma, Yokohama (JP); Tatsuo Nanjo, Kawasaki (JP); Keiichiro Tsukuda, Yokohama (JP); Yasuo Kotaki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/288,879

(22) Filed: Oct. 7, 2016

(65) Prior Publication Data

US 2017/0120608 A1 May 4, 2017

(30) Foreign Application Priority Data

Oct. 30, 2015 (JP) ..... 2015-214265

(51) Int. Cl.
*B41J 2/175* (2006.01)

(52) U.S. Cl.
CPC ..... *B41J 2/17506* (2013.01)

(58) Field of Classification Search
CPC ..... B41J 2/17563; B41J 2/17506; B41J 2/17513; B41J 2/17503
See application file for complete search history.

(56) References Cited

U.S. PATENT DOCUMENTS

| | | | | |
|---|---|---|---|---|
| 5,425,478 | A | 6/1995 | Kotaki et al. | 222/501 |
| 5,430,471 | A | 7/1995 | Nakajima et al. | 347/87 |
| 5,504,511 | A | 4/1996 | Nakajima et al. | 347/86 |
| 5,567,373 | A | 10/1996 | Sato et al. | 264/112 |
| 5,583,549 | A | 12/1996 | Ujita et al. | 347/86 |
| 5,589,862 | A | 12/1996 | Ujita et al. | 347/87 |
| 5,604,523 | A | 2/1997 | Tsukuda et al. | 347/86 |

(Continued)

FOREIGN PATENT DOCUMENTS

JP 2004-249560 9/2004

OTHER PUBLICATIONS

U.S. Appl. No. 15/296,876, filed Oct. 18, 2016.

(Continued)

*Primary Examiner* — Patrick King
(74) *Attorney, Agent, or Firm* — Fitzpatrick, Cella, Harper & Scinto

(57) ABSTRACT

There are provided a liquid ejecting device stably containing liquid inside a liquid containing unit, a head, and a liquid filling method. The liquid ejecting device includes a liquid container that can store liquid thereinside, a head including a liquid containing unit that has a holding member capable of holding liquid thereinside and a liquid ejecting unit that ejects liquid, and a flexible member that connects the liquid container to the liquid containing unit and supplies the liquid stored inside the liquid container to the liquid containing unit, and an internal space of the liquid containing unit has a rectangular parallelepiped shape, and a value obtained by dividing a length of a long side of a cross-section along a horizontal surface in the internal space by a length of the holding member along a gravity direction is 1.5 or more in a posture having the head provided on the carriage.

12 Claims, 12 Drawing Sheets

(56) References Cited

U.S. PATENT DOCUMENTS 5,608,437 A 3/1997 Iwata et al. ..... 347/86
5,619,237 A 4/1997 Inoue et al. ..... 347/86
5,619,239 A 4/1997 Kotaki et al. ..... 347/86
5,742,310 A 4/1998 Kotaki ..... 347/86
5,751,300 A * 5/1998 Cowger ..... B41J 2/17509 347/37
5,781,213 A 7/1998 Ujita et al. ..... 347/86
5,784,088 A 7/1998 Ujita et al. ..... 347/86
5,805,188 A 9/1998 Nakajima et al. ..... 347/87
5,815,184 A * 9/1998 Ujita ..... B41J 2/17513 347/87
5,852,457 A 12/1998 Kotaki et al. ..... 347/86
5,900,889 A 5/1999 Tsukuda ..... 347/23
5,929,885 A 7/1999 Nakajima et al. ..... 347/87
5,936,650 A * 8/1999 Ouchida ..... B41J 2/175 347/89
5,988,804 A 11/1999 Kotaki et al. ..... 347/87
6,070,974 A 6/2000 Kotaki et al. ..... 347/86
6,102,533 A 8/2000 Nozawa et al. ..... 347/86
6,116,722 A 9/2000 Sato et al. ..... 347/85
6,145,975 A 11/2000 Kotaki et al. ..... 347/87
6,152,555 A 11/2000 Nozawa et al. ..... 347/49
6,170,939 B1 1/2001 Ujita et al. ..... 347/86
6,206,514 B1 * 3/2001 Tajima ..... B41J 2/17513 347/86
6,234,615 B1 5/2001 Tsukuda ..... 347/85
6,243,116 B1 6/2001 Kotaki et al. ..... 347/86
6,250,745 B1 * 6/2001 Umemura ..... B41J 2/17513 347/86
6,264,315 B1 7/2001 Nozawa et al. ..... 347/86
6,336,709 B1 1/2002 Inoue et al. ..... 347/49
6,338,546 B1 1/2002 Kotaki et al. ..... 347/49
6,361,158 B1 3/2002 Inoue et al. ..... 347/86
6,390,612 B1 5/2002 Kotaki et al. ..... 347/85
6,402,298 B1 6/2002 Nanjo et al. ..... 347/49
6,419,350 B1 7/2002 Abe et al. ..... 347/86
6,421,623 B1 7/2002 Furukawa et al. ..... 702/100
6,454,399 B2 9/2002 Ujita et al. ..... 347/86
6,565,199 B2 5/2003 Ujita et al. ..... 347/86
6,623,104 B1 9/2003 Kotaki et al. ..... 347/49
6,702,427 B2 3/2004 Shimizu et al. ..... 347/50
6,712,458 B2 3/2004 Hatasa et al. ..... 347/86
6,719,416 B2 4/2004 Anma et al. ..... 347/86
6,742,881 B2 6/2004 Kotaki et al. ..... 347/86
6,783,220 B2 8/2004 Ujita et al. ..... 347/87
6,815,381 B1 11/2004 Yamamoto et al. ..... 442/187
6,824,258 B2 11/2004 Yamamoto et al. ..... 347/86
6,827,431 B2 12/2004 Kitabatake et al. ..... 347/86
6,869,158 B2 3/2005 Kojima et al. ..... 347/19
6,877,847 B2 4/2005 Hayashi et al. ..... 347/86
6,899,417 B1 * 5/2005 Shinada ..... B41J 2/17513 347/86
6,916,085 B2 7/2005 Kotaki et al. ..... 347/49
6,942,325 B2 9/2005 Nanjo ..... 347/86
6,942,326 B2 9/2005 Hayashi et al. ..... 347/86
6,966,631 B2 11/2005 Matsuo et al. ..... 347/49
6,971,741 B2 12/2005 Nanjo et al. ..... 347/85
7,033,006 B2 * 4/2006 Ebisawa ..... B41J 2/17509 347/85
7,077,514 B2 7/2006 Inoue et al. ..... 347/86
7,104,640 B2 9/2006 Ogura et al. ..... 347/86
7,111,931 B2 9/2006 Amma et al. ..... 347/86
7,118,194 B2 10/2006 Matsuo et al. ..... 347/49
7,125,109 B2 10/2006 Watanabe et al. ..... 347/86
7,134,747 B2 11/2006 Hayashi et al. ..... 347/86
7,165,829 B2 1/2007 Hayashi et al. ..... 347/49
7,207,159 B2 4/2007 Nanjo et al. ..... 53/492
7,293,865 B2 11/2007 Tsukuda et al. ..... 347/86
7,303,090 B2 12/2007 Nanjo et al. ..... 220/360
7,350,910 B2 4/2008 Amma et al. ..... 347/86
7,384,116 B2 6/2008 Kotaki et al. ..... 347/19
7,384,129 B2 6/2008 Nagata et al. ..... 347/43
7,396,118 B2 7/2008 Ogawa et al. ..... 347/87
7,401,909 B2 7/2008 Inoue et al. ..... 347/86
7,407,274 B2 8/2008 Inoue et al. ..... 347/86
7,407,275 B2 8/2008 Inoue et al. ..... 347/86
7,552,837 B2 6/2009 Nanjo et al. ..... 220/360
7,628,475 B2 * 12/2009 Langford ..... B41J 2/1707 347/7
7,735,984 B2 6/2010 Iijima et al. ..... 347/86
7,914,137 B2 3/2011 Inoue et al. ..... 347/86
7,926,927 B2 4/2011 Kotaki et al. ..... 347/86
7,950,790 B2 5/2011 Kubo et al. ..... 347/86
8,020,978 B2 9/2011 Ogawa et al. ..... 347/86
8,047,641 B2 11/2011 Nanjo et al. ..... 347/86
8,109,617 B2 2/2012 Kotaki et al. ..... 347/86
8,136,930 B2 3/2012 Anma et al. ..... 347/86
8,205,974 B2 6/2012 Ogura et al. ..... 347/86
8,313,185 B2 11/2012 Hatasa et al. ..... 347/92
8,322,807 B2 12/2012 Seki et al. ..... 347/6
8,425,022 B2 4/2013 Inoue et al. ..... 347/86
8,469,498 B2 6/2013 Ohashi et al. ..... 347/86
8,529,037 B2 9/2013 Miyashita et al. ..... 347/86
8,550,607 B2 10/2013 Inoue et al. ..... 347/86
8,770,730 B2 7/2014 Nanjo et al. ..... 347/86
8,770,731 B2 7/2014 Miyashita et al. ..... 347/86
8,960,869 B2 2/2015 Takada et al. ..... 347/86
9,016,842 B2 4/2015 Miyashita et al. ..... 347/86
9,333,758 B2 5/2016 Koshikawa et al. . B41J 2/17556
9,352,573 B1 * 5/2016 Turgeman ..... B41J 2/17506
9,375,938 B2 6/2016 Kondo et al. ..... B41J 2/17513
2001/0015743 A1 * 8/2001 Okura ..... B41J 2/17513 347/86
2002/0130935 A1 * 9/2002 Liu ..... B41J 2/14145 347/93
2003/0058315 A1 * 3/2003 Lee ..... B41J 2/17513 347/87
2003/0071881 A1 * 4/2003 Toba ..... B41J 2/17503 347/86
2004/0246304 A1 12/2004 Takahashi et al. ..... 347/49
2005/0007420 A1 1/2005 Ogawa et al. ..... 347/50
2005/0007427 A1 * 1/2005 Bellinger ..... B41J 2/17513 347/86
2007/0070135 A1 * 3/2007 Myers ..... B29C 45/376 347/86
2011/0211028 A1 * 9/2011 Tsukamoto ..... B41J 2/17506 347/86
2013/0050310 A1 2/2013 Seki et al. ..... 347/6
2015/0343793 A1 12/2015 Takada et al. ..... B41J 2/17556
2016/0200113 A1 7/2016 Nanjo et al. ..... B41J 2/175
2016/0200114 A1 7/2016 Nanjo et al. ..... B41J 2/17553

OTHER PUBLICATIONS

U.S. Appl. No. 15/272,026, filed Sep. 21, 2016.
U.S. Appl. No. 15/294,406, filed Oct. 14, 2016.
U.S. Appl. No. 15/294,442, filed Oct. 14, 2016.
U.S. Appl. No. 15/332,604, filed Oct. 24, 2016.
U.S. Appl. No. 15/338,031, filed Oct. 28, 2016.
U.S. Appl. No. 15/353,238, filed Nov. 16, 2016.
U.S. Appl. No. 15/274,806, filed Sep. 23, 2016.

* cited by examiner

LIQUID EJECTING DEVICE, HEAD, AND LIQUID FILLING METHOD

BACKGROUND OF THE INVENTION

Field of the Invention

The present invention relates to a liquid ejecting device, a head, and a liquid filling method.

Description of the Related Art

As a liquid ejecting device (e.g., an ink-jet printing device) for ejecting liquid such as ink to print an image or character, for example, there is one having a form in which a head having an ink tank at a carriage is mounted and a main tank is arranged for storing ink at another position from the carriage. Japanese Patent Laid-Open No. 2004-249560 discloses a liquid ejecting device that supplies ink in a main tank to an ink tank on the head side through a tube, and ejects the ink from an ejecting unit. With the liquid ejecting device disclosed in Japanese Patent Laid-Open No. 2004-249560, a bulb unit for closing and opening a flow passage in response to a negative pressure in the head is connected between the tube and the head.

SUMMARY OF THE INVENTION

A liquid ejecting device of the present invention includes: a liquid container that can store liquid thereinside; a head provided on a carriage and including a liquid containing unit that has a holding member capable of holding liquid thereinside and a liquid ejecting unit that ejects liquid; and a flexible member that connects the liquid container to the liquid containing unit and supplies the liquid stored inside the liquid container to the liquid containing unit, wherein an internal space of the liquid containing unit has a rectangular parallelepiped shape, and a value obtained by dividing a length of a long side of a cross-section along a horizontal surface in the internal space by a length of the holding member along a gravity direction is 1.5 or more in a posture having the head provided on the carriage.

Further features of the present invention will become apparent from the following description of exemplary embodiments (with reference to the attached drawings).

DESCRIPTION OF THE EMBODIMENTS

However, it is found out that the liquid ejecting device disclosed in Japanese Patent Laid-Open No. 2004-249560 has the following problem. That is, vibrations are generated on a liquid surface of liquid (ink) contained in a liquid containing unit (ink tank) of the head by movement of a carriage mounting the head, impact applied to the head, and the like, and the liquid surface is oscillated in the case where the liquid is ejected. In the case where the liquid surface is oscillated, pressure due to the liquid is unstable inside the liquid containing unit, and the unstability of pressure is transmitted to the liquid inside the head. Thus, the liquid is sometimes unstably ejected from the head.

In consideration of the situations, according to the present invention, there are provided a liquid ejecting device for stably containing liquid inside a liquid containing unit, a head, and a liquid filling method.

First Embodiment

Hereinbelow, a description will be given of a liquid ejecting device and a head according to a first embodiment of the present invention.

Figure 1:
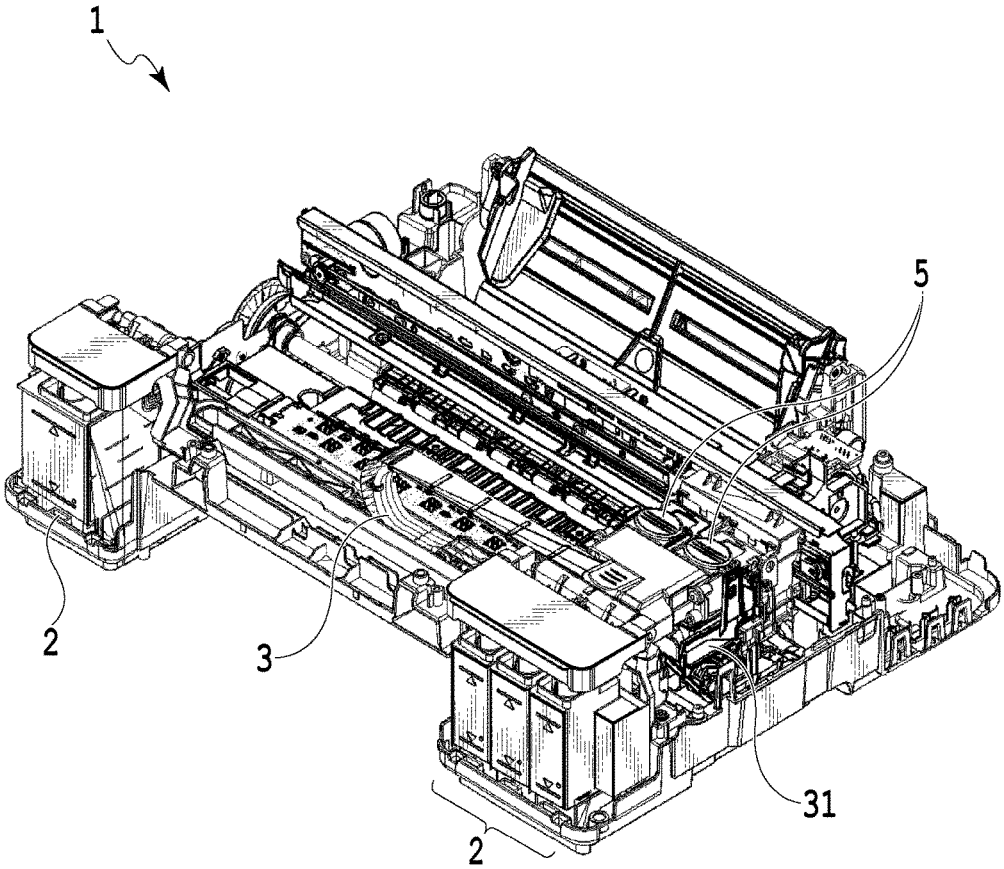
FIG. 1 is a perspective view of a liquid ejecting device.
Figure 2:
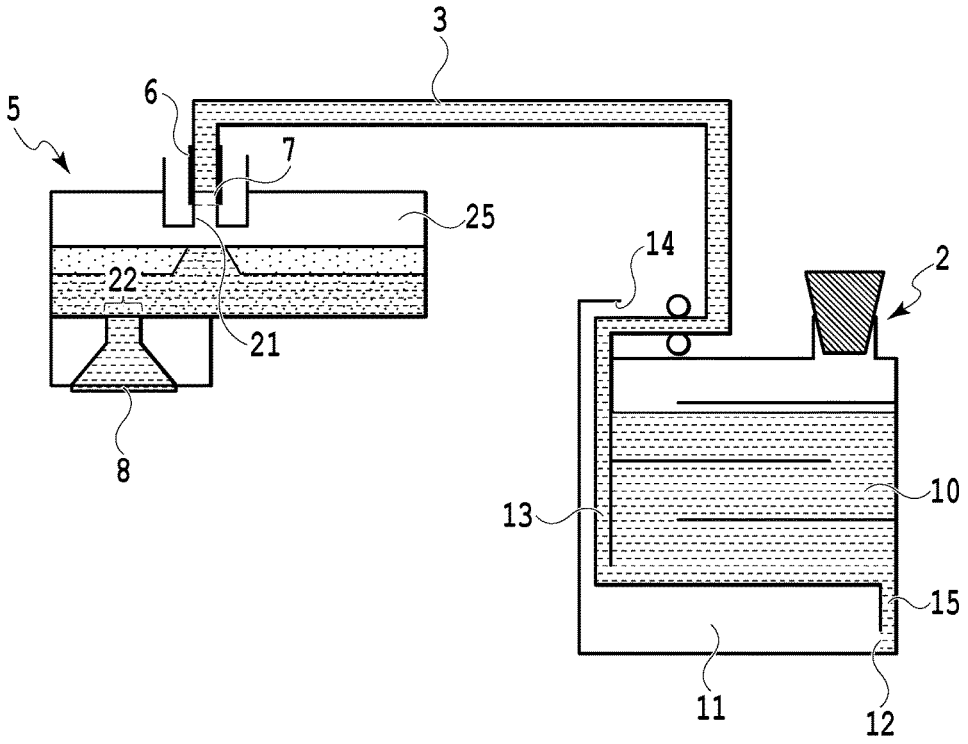
FIG. 2 is a cross-sectional view showing a liquid supply system of the liquid ejecting device of FIG. 1.

FIG. 1 shows a perspective view of a state in which an exterior of a liquid ejecting device (ink-jet printing device) 1 is detached according to the embodiment of the present invention. FIG. 2 shows a schematic cross-sectional view of a head 5 mounted in the liquid ejecting device 1 and a flow passage formed inside the head 5.

The head 5 is configured capable of being mounted on a carriage (supporting member) 31, and is provided on the carriage by being connected to a joint (not shown) provided on an upper part of the carriage 31. The head 5 is connected to a flexible member 3 such as a tube, and another end of the flexible member 3 is connected to a liquid container 2. In the case where the head 5 is attached to the carriage 31, the head 5 communicates with the liquid container 2 via the joint and the flexible member 3. The liquid ejecting device 1 is a serial-scanning-type printing device, and a carriage 31 is movably guided in a main scanning direction by a guide shaft. The carriage 31 reciprocates in a main scanning direction with a carriage motor and a driving force transmitting mechanism such as a belt that transmits its driving force.

The carriage 31 is mounted with the head 5 that integrally includes a liquid ejecting unit (ink ejecting unit) 8 and a liquid containing unit (ink tank unit) 25 that supplies liquid (ink) to the liquid ejecting unit 8. As mentioned above, the carriage 31 is configured capable of supporting the head 5. The liquid containing unit 25 in the head 5 is configured capable of storing the liquid thereinside. Note that the liquid containing unit and the liquid ejecting unit may not be integrated, but may be separately formed.

A printing medium such as a sheet is conveyed in a sub-scanning direction perpendicular to a main scanning direction of the carriage 31 with a conveyance roller. The liquid ejecting device 1 repeats a printing operation for ejecting the liquid to a print area of the printing medium on a platen while moving the liquid ejecting unit 8 in the main scanning direction and a conveying operation for conveying the printing medium in the sub-scanning direction by a distance corresponding to a printing width thereof. Thus, images are sequentially printed (formed) on the printing medium.

A plurality of ejecting ports, a plurality of pressure chambers communicated with the plurality of ejecting ports, and a plurality of flow passages communicated with the pressure chambers are respectively formed in the liquid ejecting unit 8 in the head 5. The liquid is supplied via the respective flow passages to the pressure chambers formed inside the liquid ejecting unit 8 from the liquid containing unit 25 in the head 5. Each pressure chamber has, e.g., a heat generating element (electricity/heat converter) as an energy generating element. The heat generating element is energized via a wiring, and thermal energy is generated from the heat generating element, thereby heating the liquid in the pressure chamber and generating bubbles with film boiling. Liquid droplets are ejected from the ejecting port with bubble generating energy at this time. A piezoelectric element or the like may be used as an energy generating element.

The head 5 includes the liquid containing unit 25. The liquid containing unit 25 in the head 5 is formed, mainly with a cover member 17 attached to a case 16. The liquid supplied to the liquid ejecting unit 8 is once stored inside the liquid containing unit 25.

As shown in FIG. 2, the head 5 is connected to the liquid container 2 via the flexible member 3. A joint 6 is attached to an end of the flexible member 3 on the head side. As mentioned above, the liquid container 2 that contains a relatively large amount of liquid is placed at the outside of the carriage 31 in the liquid ejecting device 1. The liquid container 2 is arranged at another position from the carriage 31, and is further connected to the liquid containing unit 25 of the head 5 mounted on the carriage 31 via the flexible member 3 such as a tube. The liquid is directly stored in the liquid container 2. In order to increase a storage amount of the liquid, preferably, a holding member for holding liquid, such as sponge, is not arranged inside the liquid container 2. As mentioned above, the liquid container 2 is connected to the head 5 with the flexible member 3 and the liquid in the liquid container 2 is continuously supplied to the liquid containing unit 25 in the head 5.

Figure 3:
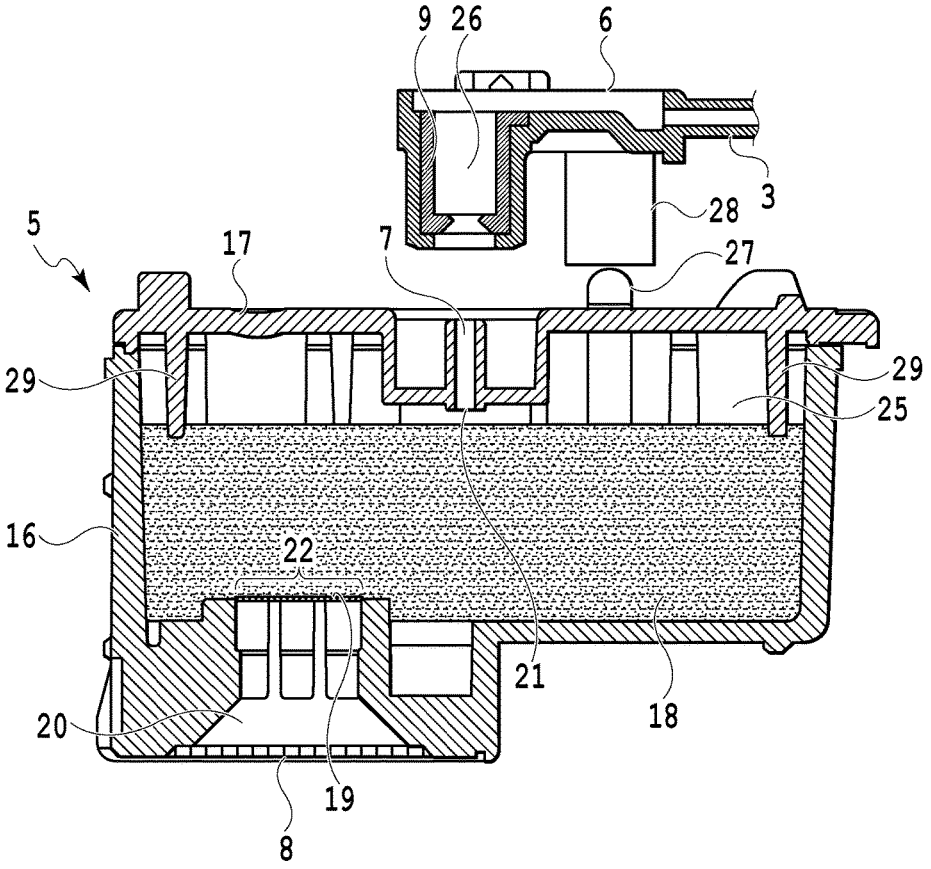
FIG. 3 is a cross-sectional view showing a head mounted in the liquid ejecting device of FIG. 1 and a joint of a flexible member connected to the head.
Figure 4:
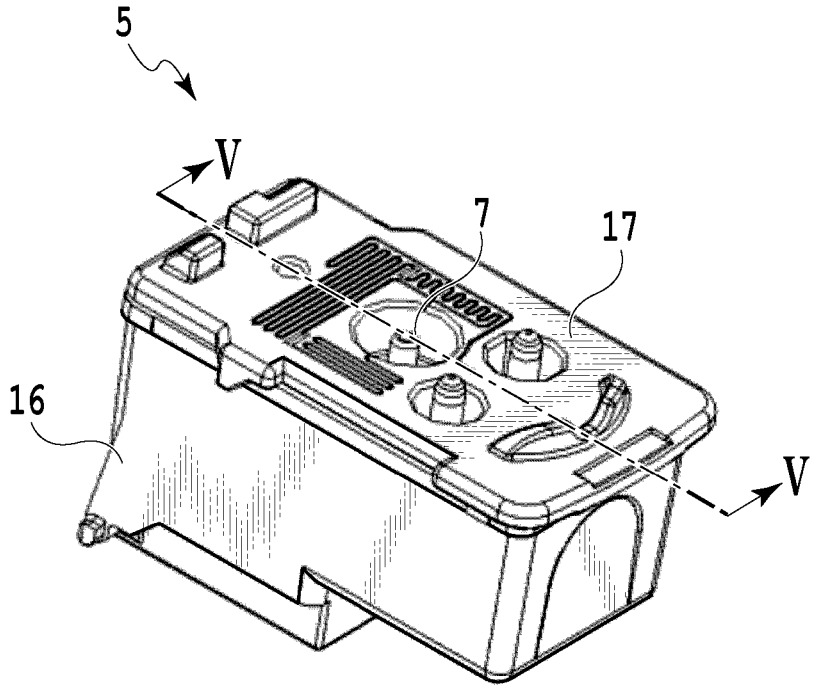
FIG. 4 is a perspective view showing the head of FIG. 3.

FIG. 3 shows a cross-sectional view of the head 5 and the joint 6 attached to the head 5 side of the flexible member 3 connected to the head 5. FIG. 4 shows a perspective view of the head 5. A liquid supply tube 7 as a pipe-shaped flow passage is provided to the head 5. The liquid supply tube 7 projects from the cover member 17 of the head 5 in a direction (direction towards the joint 6) to the outside of the liquid container. The liquid supply tube 7 is connected to a supply passage 26 of the joint 6, thereby connecting the head 5 to the joint 6. As a consequence, the head 5 is connected to the flexible member 3.

A sealing state is formed inside the head 5, excluding an ejecting port of the liquid ejecting unit 8 and an opening part of the liquid supply tube 7. An elastic member 9 is arranged inside the supply passage 26 of the joint 6. The elastic member 9 is arranged between an outer peripheral portion of the liquid supply tube 7 and an inner peripheral portion of the supply passage 26 of the joint 6, thereby sealing a space between the liquid supply tube 7 of the head 5 and the supply passage 26 of the joint 6. Thus, the liquid can be preferably supplied from the joint 6 to the head 5.

As mentioned above, the liquid container 2 is connected to another end side of the side connected to the head 5 in the flexible member 3. Mainly, the liquid container 2 is divided into the liquid containing unit 10 and a buffer chamber 11. The liquid containing unit 10 ensures the sealing of the inside, except for the communication opening 12. A linking tube 13 is attached to the liquid containing unit 10. The inside of the liquid containing unit 10 communicates with the flow passage of the linking tube 13, and they are connected to each other.

The linking tube 13 is provided near the lowermost position of the liquid containing unit 10 in the gravity direction thereof. An external air communication hole 14 is provided to the buffer chamber 11. The inside of the buffer chamber 11 communicates with external air. The liquid containing unit 10 communicates with the buffer chamber 11 via a communication path 15 and the communication opening 12. In the case where the environment temperature of the liquid container 2 is higher or the environmental pressure is low, the buffer chamber 11 is a space for escaping the liquid corresponding to the expansion of air inside the liquid containing unit 10 or in the head 5.

As shown in FIG. 2, a portion in contact with the external air in the liquid supply passage is only the ejecting port of the liquid ejecting unit 8 of the head 5 and the communication opening 12 of the liquid container 2. Further, in a state in which the head 5 is mounted in the liquid ejecting device 1, the liquid ejecting unit 8 is arranged at a position higher than the water level of the liquid container 2. Therefore, with water head difference, a negative pressure is formed inside the liquid ejecting unit 8. The negative pressure prevents the drop of the liquid from the ejecting port of the liquid ejecting unit 8, thereby holding the liquid inside the liquid ejecting unit 8. With the structure, the water head difference becomes that between a position of the ejecting port of the liquid ejecting unit 8 and a position of the communication opening 12 of the liquid container 2. Therefore, even in the case where the liquid surface of the liquid inside the liquid containing unit 10 in the liquid container 2 is at any position, a constant negative pressure can be kept inside the liquid ejecting unit 8.

Further, in the case where the ejection of the liquid from the ejecting port of the liquid ejecting unit 8 continues by the printing, the negative pressure in the head 5 is thus increased. In the case where the negative pressure inside the liquid ejecting unit 8 is larger than the sum of flow resistance of a liquid supply passage from the liquid container 2 to the head 5 and meniscus force in the communication opening 12, external air is supplied to the liquid containing unit 10 from the communication opening 12. Therefore, the liquid is supplied from the liquid container 2 to the head 5 via the flexible member 3. As a consequence, the negative pressure in the head 5 is reduced and a previous state before the printing is recovered. Therefore, the negative pressure inside the liquid ejecting unit 8 is kept constant.

Repeating the series of operations as mentioned above allows supply of the liquid to the head 5 from the liquid container 2 in the liquid ejecting device 1.

As the carriage 31 is moved in the main scanning direction, the head 5 is moved accordingly, and the liquid is ejected from the liquid ejecting unit 8. The ejected liquid lands on the printing medium or the like to perform the printing. During the printing, the liquid contained in the liquid container 2 is supplied to the liquid containing unit 25 of the head 5 via the flexible member 3. As a result, the liquid in the liquid container 2 is continuously supplied to the liquid containing unit 25 of the head 5.

The holding member 18 that can hold the liquid is stored inside the liquid containing unit 25 of the head 5. The example of the holding member 18 includes a fiber suction member. Further, in a flow passage from the liquid containing unit 25 to the liquid ejecting unit 8 in the head 5, a filter 19 is provided not to mix dust to the liquid ejecting unit 8. The liquid with a constant quantity is held in the holding member 18.

An ejecting port for ejecting the liquid in the liquid ejecting unit 8 is provided at the bottom in the gravity direction in the case 16. The holding member 18 for holding the liquid is arranged in the case 16. The liquid containing unit 25 communicates with a liquid chamber (liquid flow passage) 20 communicated with the ejecting port of the liquid ejecting unit 8 via the filter 19. The cover member 17 is welded to the opening on the upper surface in a state of mounting to the carriage 31 in the case 16.

A rib is formed on the cover member 17. The rib provided on the cover member 17 presses the holding member 18 downward in the gravity direction by the welding of the cover member 17 to the case 16. As a result, the holding member 18 and the filter 19 are configured to reliably and closely contact with each other.

In order to supply the liquid held in the holding member 18 to the liquid ejecting unit 8, it is required to keep a state in which the holding member 18 and the filter 19 are press-contacted with each other. Thus, a pressing rib 29 for pressing the holding member 18 toward the filter 19 is arranged on the rear surface of the cover member 17. Therefore, in the case where the cover member 17 is welded and attached to a cartridge case 4 of the liquid containing unit in a state in which the holding member 5 is stored in the liquid containing unit, a pressing rib 29 presses the holding member 5, and thereby the holding member 18 and the filter 19 are reliably and closely contacted with each other. Since the holding member 18 and the filter 19 are arranged to reliably and closely contact with each other, the liquid is efficiently supplied to the liquid ejecting unit 8 from the holding member 18 via the filter 19.

Further, the liquid supply tube 7 serving as a connecting unit to the joint 6 is formed in the cover member 17. The liquid supplied to the liquid containing unit 25 of the head 5 from the joint 6 enters the head 5 through the liquid supply tube 7 of the cover member 17. The liquid supplied inside the liquid containing unit 25 of the head 5 is once held in the holding member 18, and passes through the holding member 18, the filter 19, and the liquid chamber 20, thereby being guided to the ejecting port. A projected portion 27 for positioning to the joint 6 is formed on the cover member 17. The projected portion 27 is pin-shaped, and is projected from the cover member 17 in a direction (direction towards the joint 6 of the flexible member 3) to the outside of the liquid containing unit.

A positioning port 28 is formed at a position corresponding to the projected portion 27 in the joint 6. The projected portion 27 formed on the cover member 17 is inserted to the positioning port 28 formed on the joint 6, thereby properly positioning between the cover member 17 and the joint 6. Thus, the joint 6 can be precisely attached to the head 5.

Figure 5:
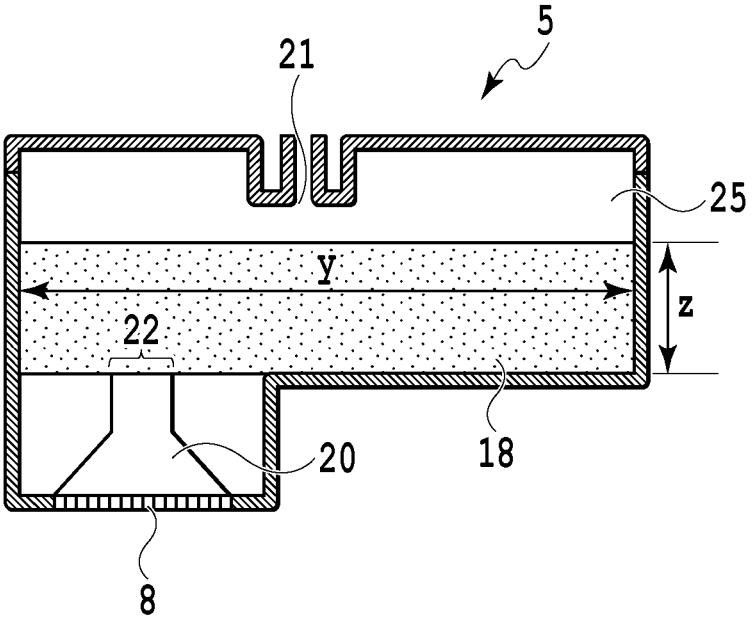
FIG. 5 is a cross-sectional view of the head of FIG. 4 along a line V-V.

Next, a description is given of a shape of the liquid containing unit 25 of the head 5. FIG. 5 shows a cross-sectional view along a line V-V of the head 5 shown in FIG. 4.

In the head 5 of the first embodiment, reference symbol z denotes a length of a side of the holding member 18 in a height direction in a posture in which the head 5 is mounted in the liquid ejecting device, and reference symbol y denotes a length of a side of an inner wall of the liquid containing unit of the liquid containing unit 25 along a sub-scanning direction. At this time, the head 5 is formed so that y/z is 1.5 or more. That is, an internal space of the liquid containing unit 25 of the head 5 is formed into a rectangular parallelepiped shape. In a posture in which the head 5 is provided on the carriage 31, the head 5 is formed so that a value obtained by dividing a length of a long side of a cross-section along a horizontal surface of the internal space by a length of the holding member 18 along the gravity direction is 1.5 or more.

Since the liquid containing unit 25 and the holding member 18 of the head 5 are thus formed, the cross-section area along a surface in parallel with the horizontal surface of the liquid containing unit 25 is widened. The liquid containing unit 25 that stores the liquid has a space with a wide cross-sectional area. On the other hand, the flow passage towards the liquid ejecting unit 8 communicated with the space is formed with a narrow cross-sectional area. Thus, in the case where the liquid flows in the flow passage towards the liquid ejecting unit 8 from the liquid containing unit 25, high resistance is generated. Since high resistance is generated in the flow of the liquid, it is difficult for the liquid stored in the liquid containing unit 25 to flow therefrom.

Further, inside the liquid containing unit 25 of the head 5, the liquid is held by the holding member 18. Therefore, in the case where the liquid flows therefrom, higher resistance is applied to the liquid. Since higher resistance is applied to the movement of the liquid, even in the case where impact is applied to the head 5 and inertia force due to scanning with the head 5 is applied to the liquid inside the liquid containing unit 25, the liquid is stably contained in the liquid containing unit 25.

Furthermore, in the head 5, the supply port 21 is not arranged at a position facing the flow passage entrance 22 communicated with the liquid chamber 20 adjacent to the liquid ejecting unit 8. The supply port 21 is opened to the inside of the liquid containing unit and is an entrance of the liquid supplied from the liquid container into the inside of the liquid containing unit. The supply port 21 is at a position offset from the position facing a forming position of the flow passage entrance 22 where the internal space of the liquid containing unit 25 and the liquid chamber 20 communicate with each other. Therefore, the liquid supplied to the liquid containing unit moves without fail in the horizontal direction (with a component in the horizontal direction) inside the holding member 18 until the liquid is supplied to the liquid ejecting unit 8.

In the case where the liquid moves in the horizontal direction inside the holding member 18, relatively high resistance is received from the holding member 18. Therefore, the liquid passing through the part is difficult to move further. Therefore, the liquid that is once contained inside the liquid containing unit is difficult to move further. The liquid is unlikely to receive influence from vibrations and the like, and is more stably contained.

In case the holding member is not arranged in the liquid containing unit and the liquid is directly contained in the liquid containing unit, further in the case where inertia force due to the impact or scanning is applied to the liquid contained inside the liquid containing unit, vibrations may be generated on the liquid surface. As a consequence, pressure of the liquid contained inside the liquid containing unit may change and the scale of the pressure of the liquid contained inside the liquid containing unit may become unstable. However, in the head 5 of the present embodiment, the liquid is held by the holding member 18 inside the liquid containing unit, and thus the movement of the liquid due to the oscillation can be suppressed.

From the above, the liquid is stably contained in the liquid containing unit, and therefore, the liquid can be stably supplied to the liquid ejecting unit from the liquid containing unit. Since the liquid is stably supplied to the liquid ejecting unit, the liquid can be stably ejected from the ejecting port of the liquid ejecting unit. Thus, it is possible to precisely eject the liquid from the liquid ejecting unit. Therefore, it is possible keep high quality of a printed image obtained by the printing.

Further, the liquid stored inside the liquid containing unit 25 is difficult to flow therefrom. On the other hand, air bubbles remaining in the liquid containing unit 25 easily flow therefrom. Therefore, by using a difference in easiness of flow between the liquid and the air bubbles, it is possible to easily remove the air bubbles from the liquid ejecting unit 8 and the liquid containing unit 25.

Even in the case where air flows in the liquid containing unit 25 and air bubbles are generated, flow resistance of the liquid flow inside the liquid containing unit 25 is high. Therefore, in the case where suction is performed via the ejecting port of the liquid ejecting unit 8, the amount of the liquid does not follow the degree of suction and only the air bubbles are thus efficiently removed. Further, since the negative pressure inside the liquid containing unit 25 is easily increased, it is possible to obtain a similar effect to that in choke suction with suction from the ejecting port in a state in which the liquid containing unit 25 is sealed. Therefore, since the air bubbles are removed from the liquid containing unit 25 in the head 5 with a simple structure, it is possible to realize small size and low costs of the printing device.

As a mechanism for removing the air bubbles, an area around the ejecting port of the liquid ejecting unit 8 of the head 5 is covered with a cap.

First, the space between the cap and the liquid ejecting unit 8 is sealed with the cap. In this state, a sucking pump is connected to the cap, thereby sucking the air by the sucking pump from the sealed space. As a result, the air bubbles remaining inside the liquid containing unit 25 are sucked together with the ink from the space sealed by the cap and the liquid ejecting unit 8, and the air bubbles are consequently removed from the liquid ejecting unit 8 and the liquid containing unit 25.

With this method, the liquid is supplied to the liquid containing unit 25 of the head 5 via the flexible member 3 from the liquid container 2, and the air bubbles together with the liquid are removed from the ejecting port of the liquid ejecting unit 8.

Furthermore, in the liquid containing unit 25 of the head 5, the supply port 21 is not arranged at a position just on the top facing the flow passage entrance 22 communicated with the liquid ejecting unit 8. The supply port 21 is offset and formed from a position facing the flow passage entrance 22 through which the liquid is supplied to the liquid ejecting unit 8. Therefore, the liquid flowing to the liquid ejecting unit 8 passes through the holding member 18 with suction in the case where the suction is performed from the ejecting port of the liquid ejecting unit 8 for the purpose of removing the air bubbles. In this case, a constant amount of the liquid is stored in the liquid containing unit 25 with capillary force of the holding member 18.

In the case where the liquid ejecting device 1 is used for a long time, air gradually comes into the liquid containing unit 25 from a part of, e.g., the flexible member due to the difference in humidity from the external air, and air bubbles are generated inside the liquid containing unit 25. Therefore, it is required to evacuate air at an interval of a predetermined period. However, according to the invention, the distance from the ink supply position to the flow passage entrance to the liquid chamber is long, and an area for holding the liquid is increased, thereby holding a large amount of the liquid.

Moreover, it is so configured that the resistance of the flow for supplying the liquid to the liquid ejecting unit is increased with the liquid stored inside the liquid containing unit 25. In removing the air bubbles, only the air bubbles are removed without sucking a large amount of the liquid. Therefore, it is not necessary to suck a large amount of the liquid together in removing the air bubbles. Accordingly, it is possible to suppress an amount of liquid suction to be small in the suction.

Since the air bubbles are sufficiently removed with a small amount of liquid suction, driving force of the suction can be reduced, and the pump used for the suction can be reduced in size. Therefore, the liquid ejecting device 1 can be reduced in size and manufacturing costs of the liquid ejecting device 1 can be reduced. Further, the liquid inside the liquid containing unit 25 is sucked, thereby reducing the amount of liquid suction with a recovery operation in performing the recovery operation of the liquid inside the liquid containing unit 25. As a result, the consumption amount of the liquid can be reduced.

Moreover, the air bubbles can be fully sucked with low suction. Since the air bubbles are reliably sucked and removed, the interval for performing suction can be extended long. Therefore, the frequency for performing suction can be reduced and the number of suction can be reduced. Therefore, the amount of liquid discharged by the suction can be reduced, and the amount of consumption of the liquid can be further reduced. Since the amount of consumption of the liquid is reduced, operating cost of the liquid ejecting device can be reduced.

Second Embodiment

Next, a description is given of a head 52 according to a second embodiment of the present invention. Note that a description will be omitted of parts similarly constituted to those of the first embodiment with the same reference numerals attached in the drawings, and only different parts will be explained.

Figure 6:
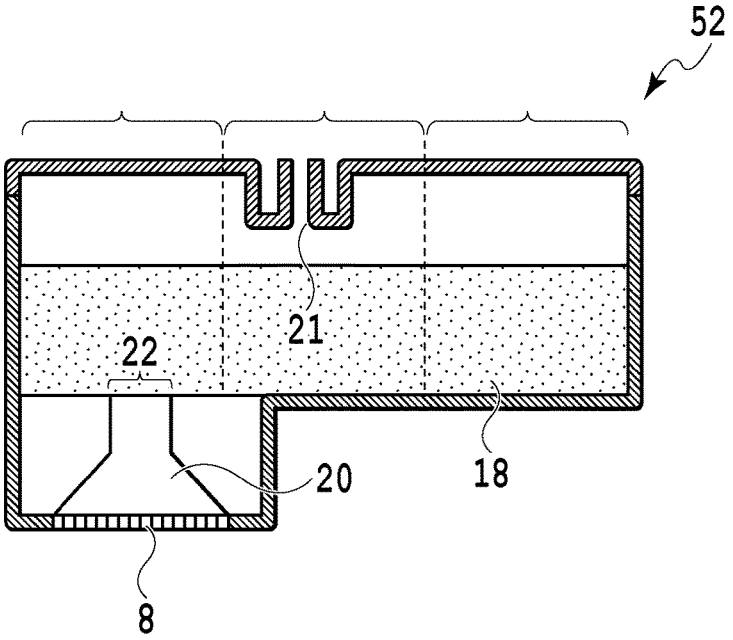
FIG. 6 is a schematic cross-sectional view of the head mounted in a liquid ejecting device.

FIG. 6 shows a cross-sectional view of the head 52 according to the second embodiment. In the case where the liquid containing unit 25 of the head 52 is equally divided into three areas in a longitudinal direction (extending direction of the long side), the center of the flow passage entrance 22 to the liquid chamber 20 is arranged in the area in one end. Further, of the three divided areas, the supply port 21 is arranged in the area of the center portion.

According to the second embodiment, in the case where the supply port 21 is arranged in the end area on the opposite side of the flow passage entrance, the distance for the passage of the liquid inside the holding member 18 is longer. Thus, pressure loss is too high, and the ejection of the liquid may be unstable. In this case, as shown in FIG. 6, preferably, the supply port 21 and the flow passage entrance 22 are arranged with a not-long distance. Therefore, according to the present embodiment, of the three divided areas, the flow passage entrance 22 is arranged in an area of one end, and the supply port 21 is arranged in the area of the center portion.

Third Embodiment

Next, a description is given of a head 53 according to a third embodiment of the present invention. Note that a description will be omitted of parts similarly constituted to those of the first and second embodiments with the same reference numerals attached in the drawings, and only different parts will be described.

Figure 7:
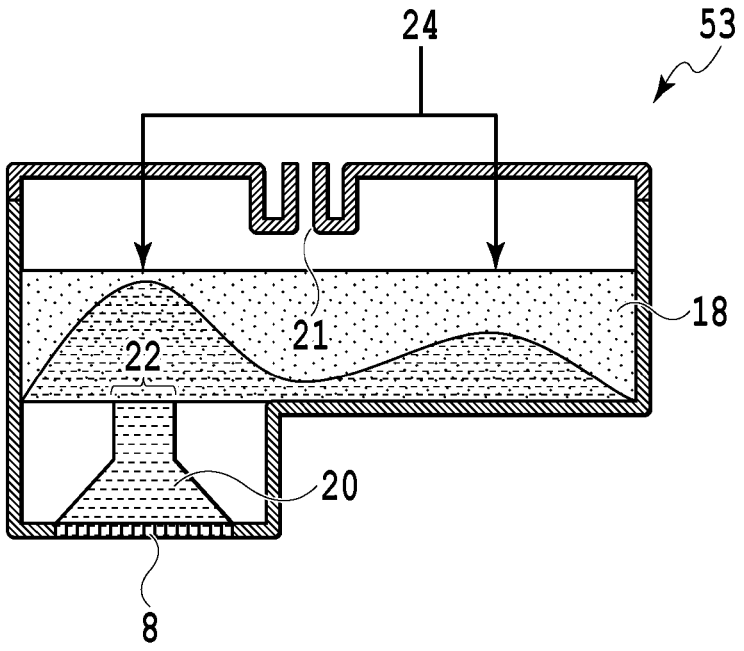
FIG. 7 is a schematic cross-sectional view of the head mounted in a liquid ejecting device.

FIG. 7 shows a cross-sectional view of an initial ink injection state to the head 53 according to the third embodiment of the present invention. The ink is fitted in advance to the holding member 18 of the head 53, thereby stably supplying the liquid with the subsequent liquid supply, and the liquid is stably ejected from the liquid ejecting unit 8. Therefore, in an injection process of the liquid to the head in progress of manufacturing, in a state in which a plurality of injection needles is inserted to the holding member 18, the initial liquid is injected and the liquid is filled in the liquid containing unit 25. That is, the liquid is filled in the internal space from the leading end at a position corresponding to the flow passage entrance 22 where the liquid chamber 20 through which the liquid is supplied to the liquid ejecting unit 8 from the internal space communicates with the internal space, and a liquid supply needle (liquid supply needle) for insertion to the holding member 18 is inserted. Then, the liquid is filled in the internal space via the liquid supply needle.

With capillary force of the holding member 18, the distribution of the liquid is gradually widened with an insertion position 24 of the liquid injection needle as apex, and the liquid is convexly injected as a result. In the head 53 of the third embodiment, the insertion position 24 of the liquid injection needle is arranged to the position corresponding to the flow passage entrance 22 of the liquid chamber 20 serving as the flow passage of the liquid ejecting unit 8, and the liquid is filled to the liquid containing unit 25. Therefore, with the liquid filling method of the third embodiment, the liquid can be stably supplied to the liquid ejecting unit 8, and the liquid can be stably ejected from the liquid ejecting unit 8.

In the case where the apex of the distribution form of the liquid is positioned just under the supply port 21, the liquid may leak from the supply port 21 at the time of distribution of goods. Therefore, the head may get dirty at the time of distribution of goods. Therefore, preferably, the supply port 21 is arranged at the position that is not just above the initial liquid injection position 24 to the liquid containing unit 25.

Fourth Embodiment

Next, a description is given of a head 54 according to a fourth embodiment of the present invention. Note that a description is omitted of parts similarly constituted to that of the first to third embodiments with the same reference numerals attached, and only different parts will be described.

Figure 8A:
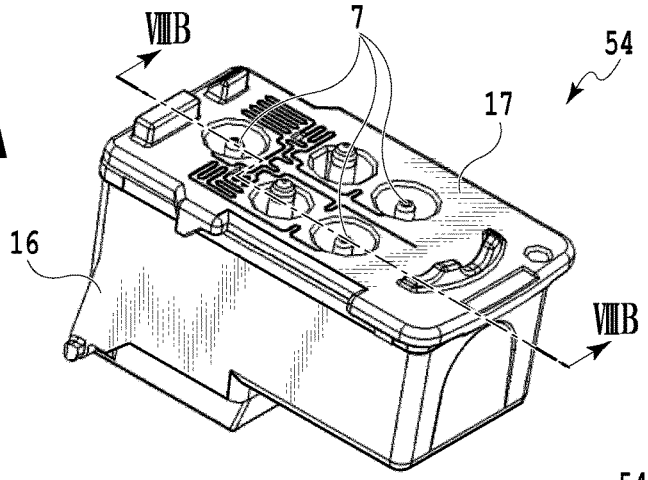
FIG. 8A is a perspective view of the head mounted in a liquid ejecting device.
Figure 8B:
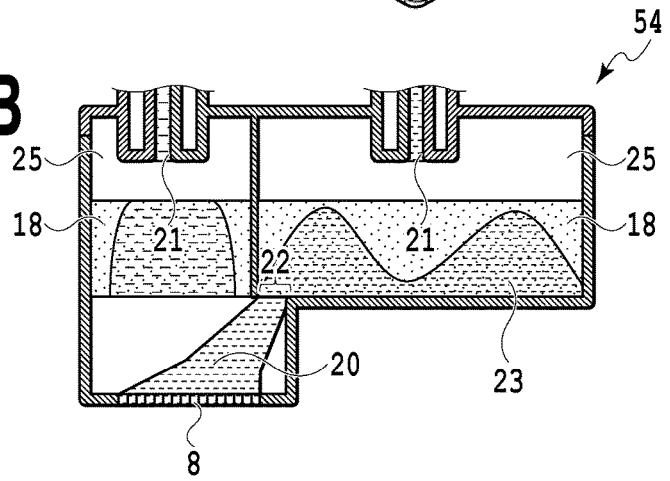
FIG. 8B is a schematic cross-sectional view of the head of FIG. 8A along a line VIIIB-VIIIB.
Figure 8C:
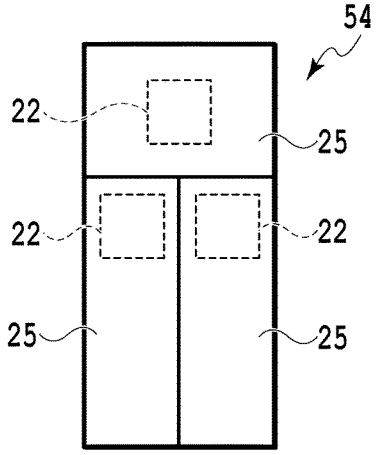
FIG. 8C is a plan view of the head of FIG. 8A.

FIGS. 8A to 8C show the head 54 of the fourth embodiment. FIG. 8A is a perspective view of the head 54, FIG. 8B is a cross-sectional view of the head 54 of FIG. 8A along a line VIIIB-VIIIB, and FIG. 8C is a plan view of the liquid containing unit 25 of FIG. 8A seen from the top. As shown in FIG. 8B, the liquid containing unit 25 is partitioned into a plurality of spaces in the head 54. In the liquid containing unit 25 that is partitioned into a plurality spaces, in a part thereof, the supply port 21 may not be arranged just above the flow passage entrance 22 to the liquid containing unit 25.

Fifth Embodiment

Next, a description is given of heads 55*a* and 55*b* according to a fifth embodiment of the present invention. Note that a description will be omitted of parts similarly constituted to those of the first to fourth embodiments with the same reference numerals attached, and only different parts will be described.

Figure 9A:
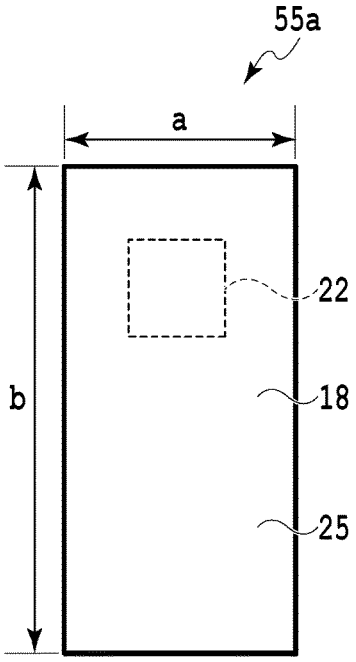
FIG. 9A is a plan view in the case where there is one liquid containing unit at a head mounted in a liquid ejecting device.
Figure 9B:
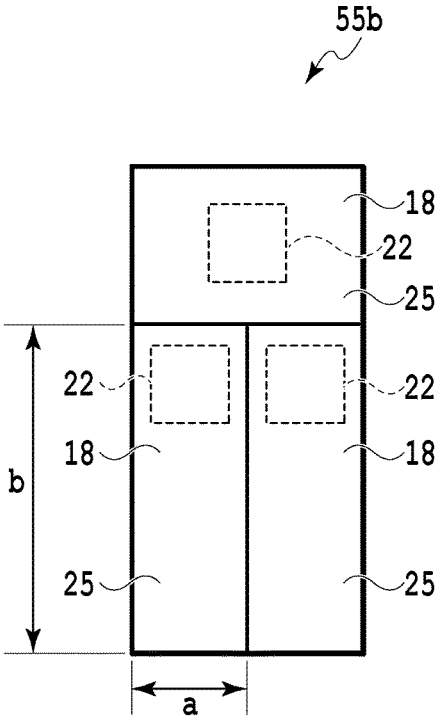
FIG. 9B is a plan view in the case where there is a plurality of liquid containing units.

FIG. 9A shows, in the case where one liquid containing unit is formed in one head, a plan view of the head 55*a* according to the fifth embodiment with the liquid containing unit 25 seen from the cover member side. FIG. 9B shows a plan view of the head 55*b* according to the fifth embodiment with the head 55*b* seen from the cover member side, in the case where the liquid containing unit 25 is partitioned into a plurality of spaces that are formed in one head.

The head 55*a* is formed substantially into a rectangular parallelepiped shape. The head 55*a* has the rectangular parallelepiped shape with a cross-section along a plain surface parallel with the horizontal surface as being rectangular. Herein, reference symbol a denotes a length of a short side and reference symbol b denotes a length of a long side. At this time, b/a is 2.0 or more.

Further, each of the divided plurality of the liquid containing units 25 is formed substantially into a rectangular parallelepiped shape in the head 55*b*. The head 55*b* of FIG. 9B is divided into three liquid containing units 25. In two of the three divided liquid containing units 25, reference symbol a denotes a length of a short side, and reference symbol b denotes a length of a long side, and b/a is 2.0 or more. Moreover, in the heads 55*a* and 55*b* of the fifth embodiment, the long side b of the cross-section along the horizontal surface of the internal space in the corresponding liquid containing unit 25 is a side extending in a direction intersecting with a moving direction of reciprocating movement of the carriage 31.

Depending on the shape of the liquid containing unit 25 in the heads 55*a* and 55*b*, the distance from the supply port 21 to the flow passage entrance 22 towards the liquid chamber 20 is not sufficient, pressure loss due to the holding member 18 may be insufficient. Therefore, the resistance of the liquid stored in the liquid containing unit 25 runs shortage and the stored ink may be unstable.

Therefore, in the heads 55*a* and 55*b* of the present embodiment, in order to sufficiently ensure the pressure loss with the holding member 18, the length of the long side b is formed to be longer than the length of the short side a. As a consequence, the length from the supply port 21 to the flow passage entrance 22 can be ensured to be sufficiently long. Depending on the configurations of the supply port 21 and the flow passage entrance 22, the pressure loss of the liquid passing through the holding member 18 can be sufficiently ensured.

Sixth Embodiment

Next, a description is given of a head 56 according to a sixth embodiment of the present invention. Note that a description will be omitted of parts similarly constituted to those of the first to fifth embodiments with the same reference numerals attached, and only different parts will be described.

Figure 10:
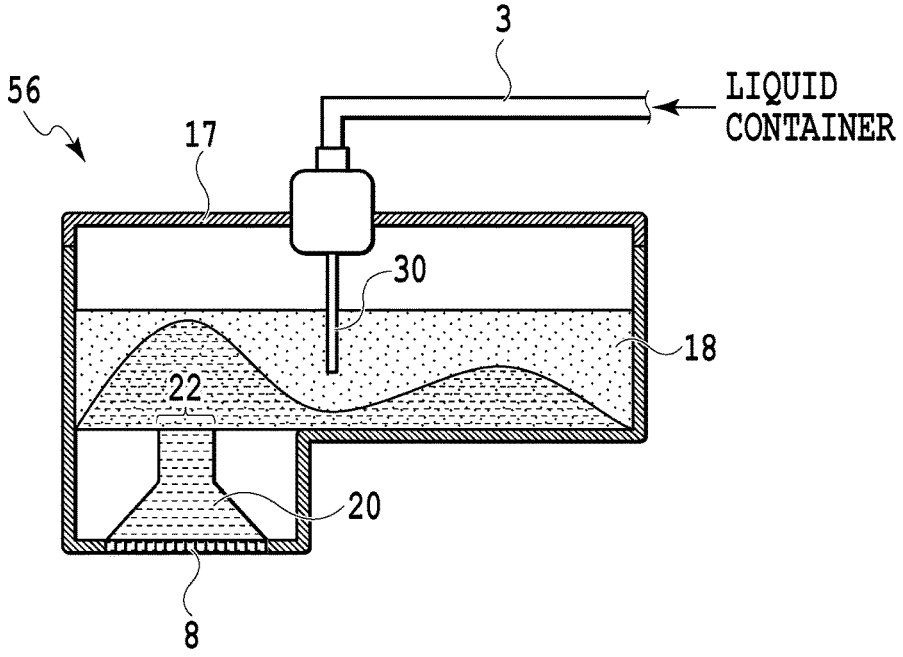
FIG. 10 is a cross-sectional view of a head, a flexible member and a connecting unit therebetween mounted in a liquid ejecting device.

FIG. 10 is a cross-sectional view of the head of the sixth embodiment. According to the first to fifth embodiments, the liquid supplied to the liquid containing unit 25 from the liquid container 2 via the flexible member 3 is supplied through the supply port 21 formed in the cover member 17. On the other hand, in the head 56 of the sixth embodiment, the liquid supply needle 30 reaching the holding member 18 is attached to the cover member 17. In a state in which the liquid supply needle 30 is inserted to the holding member 18, the liquid is supplied inside the liquid containing unit 25 of the head 56 from the liquid container 2 via the liquid supply needle 30.

As mentioned above, the liquid supply needle 30 may be used not only in the initial filling of the liquid to the head 56 but also in the supply of the liquid to the liquid containing unit 25 of the head 56 from the liquid container 2 during printing.

Further, the liquid may be continuously supplied by insertion of the liquid supply needle 30 inside the holding member 18 from the supply port 21. That is, the liquid is filled in the internal space from the leading end of the supply port 21 where the flexible member 3 and the internal space of the liquid containing unit 25 communicate with each other, and the liquid supply needle that can be inserted into the holding member 18 is inserted. The liquid is filled therefrom in the internal space via the liquid supply needle. In this case, in the case where the supply port 21 is arranged at a position offset from a position just above the flow passage entrance 22 facing the flow passage entrance 22 to the liquid chamber 20, desired pressure loss is also obtained from the holding member 18 in the liquid supply from the liquid supply needle 30.

Seventh Embodiment

Next, a description is given of a head according to a seventh embodiment of the present invention. Note that a description will be omitted of parts similarly constituted to those of the first to sixth embodiments with the same reference numerals attached, and only different parts will be described.

In the head of the seventh embodiment, fibers formed of polyolefin-based resin are used as a material forming the holding member 18. The holding member 18 is formed by twisting of the fibers formed of polyolefin-based resin.

It is so configured that the liquid is held with the capillary force of the holding member 18. In the case where the capillary force of the material forming the holding member 18 is extremely small, the pressure loss inside the liquid containing unit 25 is low. Therefore, in the head, the pressure change inside the liquid containing unit 25 is increased by oscillation of the liquid surface of the liquid caused by scanning with the head or the ink supply by the flexible member. As a consequence, the liquid from the liquid ejecting unit 8 may be unstably ejected. Further, in the case where the capillary force of the holding member 18 is extremely high, the pressure loss due to the holding member 18 is too high and the liquid may be unstably supplied to the liquid ejecting unit 8 from the liquid containing unit 25. Therefore, the capillary force of the holding member 18 is preferably adjusted at proper level.

Figure 11:
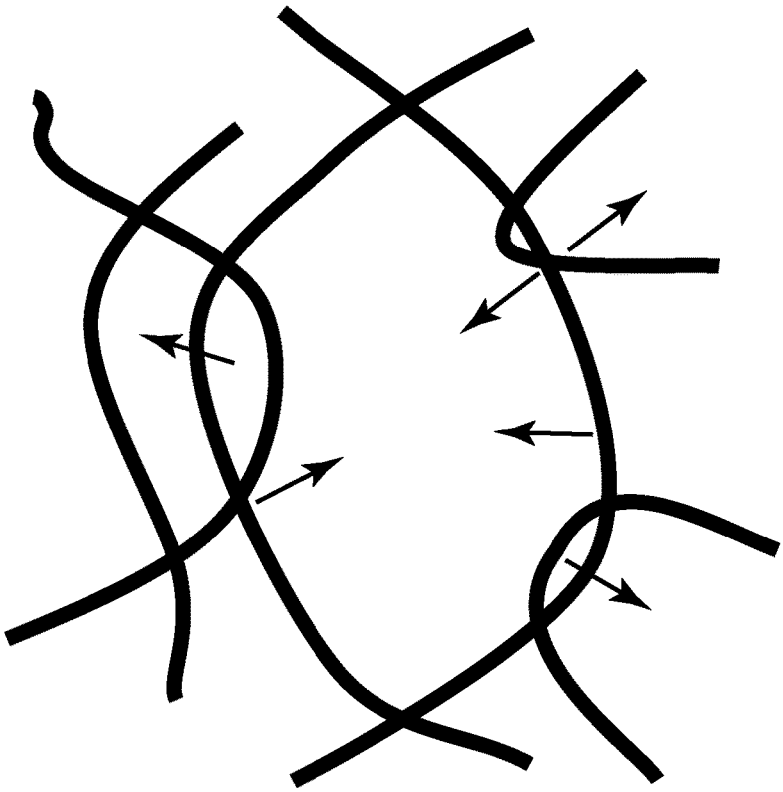
FIG. 11 is an enlarged view of fibers of a holding member that is arranged inside a head mounted in a liquid ejecting device.

In order for the holding member 18 to function as a member for generating pressure loss more suitable for the head, preferably fibers forming the holding member 18 randomly make a plurality of intersections with each other, as shown in FIG. 11. That is, in the case where the fibers are touched to the liquid, force for moving the respective fibers in a direction of an arrow is operated with surface tension, or the like, of the liquid as shown in FIG. 11. However, the plurality of intersections cancels the force. Therefore, it is possible to suppress the contraction of the fibers forming the holding member 18.

Figure 12A:
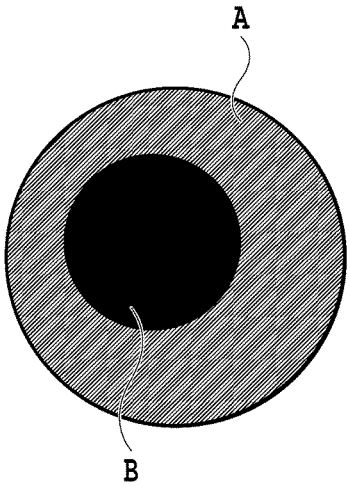
FIG. 12A is a cross-sectional view of the respective fibers of the holding member of FIG. 11.
Figure 12B:
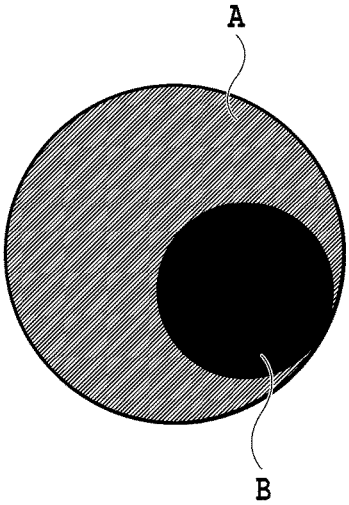
FIG. 12B is a cross-sectional view of the respective fibers of the holding member of FIG. 11.

FIGS. 12A and 12B show schematic cross-sectional views of fibers having a plurality of layers formed of different types of materials, forming the holding member 18. As shown in FIGS. 12A and 12B, a core portion B formed of a material with high melting temperature is formed inside the fibers forming the holding member 18. Further, outside the core portion B, a surface layer A is formed with melting temperature lower than that of the core portion B. As mentioned above, the fibers including the surface layer A and the core portion B are formed in a state twisted with each other as shown in FIG. 11.

Next, regarding the surface layer A of the fiber, the fiber thereof is heated at a resin temperature or more of the melted surface layer A. Regarding the core portion B of the fiber, the fiber thereof is heated at a resin temperature or less of the melted core portion B. With heating, the fibers are twisted in a state in which only the surface layer A is melted. Thus, intersection points as a result of plural intersections touch each other in a state in which only the surface layer A is melted. In the case where the surface layer A touched in the melting state is solidified, the touched fibers are melted. In a twisted state of the fibers, the intersection points of the fibers are melted and attached, and the whole fibers are therefore solidified. It is also a preferable measure to adjust the capillary force with the holding member 18 by adjusting the twisting degree at this time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-214265, filed Oct. 30, 2015, which is hereby incorporated by reference wherein in its entirety.

What is claimed is:

1. A liquid ejecting device comprising:

a liquid container that can store liquid thereinside;

a head provided on a carriage and including a liquid containing unit that has a holding member capable of holding liquid thereinside and a liquid ejecting unit that ejects liquid; and a flexible member that connects the liquid container to the liquid containing unit and supplies the liquid stored inside the liquid container to the liquid containing unit, wherein an internal space of the liquid containing unit has a rectangular parallelepiped shape, wherein a value obtained by dividing a length of a long side of a cross-section along a horizontal surface in the internal space by a length of the holding member along a gravity direction is 1.5 or more in a posture having the head provided on the carriage, wherein the internal space of the liquid containing unit is covered by a cover member, the cover member has a pressing rib, and the pressing rib presses the holding member, wherein a supply port that is opened to an inside of the liquid containing unit and is an entrance of the liquid supplied from the liquid container to the inside of the liquid containing unit is formed at a position offset from a facing position, wherein the facing position is a position facing a position at which there is formed a flow passage entrance where the internal space communicates with a liquid flow passage through which the liquid is supplied to the liquid ejecting unit from the internal space in the liquid containing unit, and wherein in a case where the internal space of the liquid containing unit is equally divided into three areas in an extending direction of the long side:

the flow passage entrance is formed in an area at one end along the extending direction of the long side of the three areas, and the supply port is formed in a center area along the extending direction of the long side of the three areas.

2. The liquid ejecting device according to claim 1, wherein the carriage is configured capable of reciprocating, and the long side of the cross-section along the horizontal surface in the internal space is a side extending in a direction intersecting with a moving direction of the reciprocating movement of the carriage.

3. The liquid ejecting device according to claim 1, wherein a value obtained by dividing the length of the long side of the cross-section along the horizontal surface in the internal space by a length of a short side of the cross-section along the horizontal surface in the internal space is 2.0 or more in a posture having the head provided on the carriage.

4. The liquid ejecting device according to claim 1, wherein the holding member is formed of fibers of polyolefin-based resin.

5. A head capable of being provided on a carriage and including a liquid containing unit that can store liquid thereinside and a liquid ejecting unit that ejects liquid, wherein the head is connected to a liquid container that can store liquid thereinside via a flexible member, the liquid stored inside the liquid container is supplied inside the liquid containing unit through the flexible member, a holding member that can hold liquid is arranged inside the liquid containing unit, an internal space of the liquid containing unit is formed into a rectangular parallelepiped shape, and a value obtained by dividing a length of a long side of a cross-section along a horizontal surface in the internal space by a length of the holding member along a gravity direction in a posture provided on the carriage is 1.5 or more, wherein the internal space of the liquid containing unit is covered by a cover member, the cover member has a pressing rib, and the pressing rib presses the holding member, wherein a supply port that is opened to an inside of the liquid containing unit and is an entrance of the liquid supplied from the liquid container to the inside of the liquid containing unit is formed at a position offset from a facing position, wherein the facing position is a position facing a position at which there is formed a flow passage entrance where the internal space communicates with a liquid flow passage through which the liquid is supplied to the liquid ejecting unit from the internal space in the liquid containing unit, and wherein in a case where the internal space of the liquid containing unit is equally divided into three areas in an extending direction of the long side:

the flow passage entrance is formed in an area at one end along the extending direction of the long side of the three areas, and the supply port is formed in a center area along the extending direction of the long side of the three areas.

6. The liquid ejecting device according to claim 1, wherein a flow path exists between the liquid containing unit and the liquid ejecting unit, and a filter is provided in the flow path.

7. The liquid ejecting device according to claim 6, wherein the filter and the holding member are pressed against each other.

8. The head according to claim 5, wherein a flow path exists between the liquid containing unit and the liquid ejecting unit, and a filter is provided in the flow path.

9. The head according to claim 8, wherein the filter and the holding member are pressed against each other.

10. The head according to claim 5, wherein the carriage is configured capable of reciprocating, and the long side of the cross-section along the horizontal surface in the internal space is a side extending in a direction intersecting with a moving direction of the reciprocating movement of the carriage.

11. The head according to claim 5, wherein a value obtained by dividing the length of the long side of the cross-section along the horizontal surface in the internal space by a length of a short side of the cross-section along the horizontal surface in the internal space is 2.0 or more in a posture having the head provided on the carriage.

12. The head according to claim 5, wherein the holding member is formed of fibers of polyolefin-based resin.

* * * * *